US005258815A

United States Patent [19]

Nakagawa et al.

[11] Patent Number: 5,258,815

[45] Date of Patent: Nov. 2, 1993

[54] FIXING APPARATUS

[75] Inventors: Kiyohari Nakagawa; Hiroyuki Honda; Jun-ichi Koiso; Shigeru Okazaki; Naoki Otomo, all of Hachioji, Japan

[73] Assignee: Konica Corporation, Tokyo, Japan

[21] Appl. No.: 996,513

[22] Filed: Dec. 16, 1992

Related U.S. Application Data

[63] Continuation of Ser. No. 762,795, Sep. 19, 1991, abandoned, which is a continuation of Ser. No. 546,029, Jun. 28, 1990, abandoned.

[30] Foreign Application Priority Data

Jul. 4, 1989 [JP] Japan ..... 1-79264[U]

[51] Int. Cl.[5] ..... G03G 15/20

[52] U.S. Cl. ..... 355/282; 355/285; 162/271

[58] Field of Search ..... 355/282, 285, 290, 315; 162/270, 271

[56] References Cited

U.S. PATENT DOCUMENTS

| | | | |
|---|---|---|---|
| 4,505,695 | 3/1985 | Billings | 162/271 X |
| 4,627,718 | 12/1986 | Wyer | 355/311 |
| 4,892,994 | 1/1990 | Tsuchiya et al. | 162/271 X |
| 5,084,731 | 1/1992 | Baruch | 355/208 |

FOREIGN PATENT DOCUMENTS

| | | | |
|---|---|---|---|
| 239274 | 10/1986 | Japan | 355/282 |

*Primary Examiner*—Michael L. Gellner
*Assistant Examiner*—P. Stanzion
*Attorney, Agent, or Firm*—Jordan B. Bierman

[57] ABSTRACT

A fixing apparatus for use in an electrophotographic copying machine for fixing a toner image on the surface of a recording paper. The fixing apparatus is provided with a fixing means to fix the toner image on a recording paper, ejecting means to eject the recording paper after the fixation of the toner image and a correcting roller located along the ejecting path of the recording paper to correct a curl of the recording paper induced during the fixing process by bending the recording paper in an opposite curvature of the curl.

5 Claims, 2 Drawing Sheets

FIXING APPARATUS

This application is a continuation of application Ser. No. 07/762,795, filed Sep. 19, 1991, now abandoned, which is a continuation of Ser. No. 07/546,029 filed Jun. 28, 1990 now abandoned.

BACKGROUND OF THE INVENTION

The present invention relates to a fixing apparatus that fixes unfixed images, and more particularly to one wherein a curl on a recording paper generated after fixing is corrected.

In a fixing apparatus, especially in an apparatus wherein heat is used for fixing, when a recording paper having toner images on the obverse thereof is given heat whose amount is larger than that given on the reverse of the paper only on its obverse or on the space on the side of the obverse, it is considered that the moisture in the recording paper is expelled unevenly between the obverse and the reverse of the recording paper, and due to a 'bimetal-effect', the paper curls heavily, while changing in its length and width depending on the amount of moisture expelled.

The curl mentioned above is one of the factors to cause paper jamming and deterioration of paper transportability in duplex copying in an electrophotographic apparatus.

In a fixing apparatus of a thermal fixing roller type, in particular, a recording paper curls more heavily toward the heat source side because the recording paper touches the heat source regardless of whether toner exists on the recording paper or not. Further, in the case of a fixing apparatus composed of a pair of a rigid roller and an elastic roller, a recording paper is given, at the location where the recording paper contacts the roller, a mechanical external force that forcibly bends the recording paper toward the rigid roller, thus, the curl is accelerated.

From the viewpoint mentioned above, there has been developed a fixing apparatus wherein the heating source is provided not on the side of a rigid roller but on the side of an elastic roller, and toner images contact the rigid roller and a recording paper is heated from its reverse side. Nevertheless, a fixing apparatus of this type still has a disadvantage that the thermal efficiency is low, though a recording paper is less curled.

Further, Japanese Patent Publication Open to Public Inspection No. 34572/1984 has disclosed a curl prevention means wherein a guide member having a curved surface that is curved in the direction opposite to the curl of a recording paper is provided just behind the heating source or the pressing source, thereby the curl generated on the recording paper is corrected, before the curl is set, to the original state.

In a fixing apparatus provided with aforesaid curl-prevention means, however, there occurs a phenomenon that coagulated toners and paper dust stick to the curved surface of aforesaid curl-prevention means when it is used for a long time, because images on the recording paper are kept in contact with the curved surface of the curl-prevention means.

Coagulated toners and paper dust sticking to the curved surface of a curl-prevention means cause soil on the image surface of the recording paper. In addition to that, when the curvature is increased, there is a fear that the curl-prevention means having aforesaid curved surface deviates with buckling from the paper-transport path in the fixing apparatus.

An object of the invention is to offer a fixing apparatus wherein the curl of a recording paper generated in the course of image-fixing is corrected, and thus the troubles caused by the aforesaid curl such as occurrence of paper jamming and deterioration of paper transportability in duplex copying in an electrophotographic apparatus, for example, are eliminated.

SUMMARY OF THE INVENTION

The invention capable of achieving aforesaid objects is represented by a fixing apparatus comprising a fixing member that applies heat and pressure on a recording paper having thereon transferred unfixed images for the purpose of fixing the unfixed images and a paper-ejecting member that ejects aforesaid recording paper having thereon fixed images, wherein there is provided, for the purpose of correcting the curl, a curl-prevention roller that guides the recording paper toward the direction opposite to the curl generated on the recording paper in the course of image-fixing.

BRIEF DESCRIPTION OF THE DRAWINGS

An example of the invention is shown in FIGS. 1–4 wherein.

DETAILED DESCRIPTION OF THE INVENTION

An example of the invention will be explained as follows, referring to the attached drawings.

Figure 1:
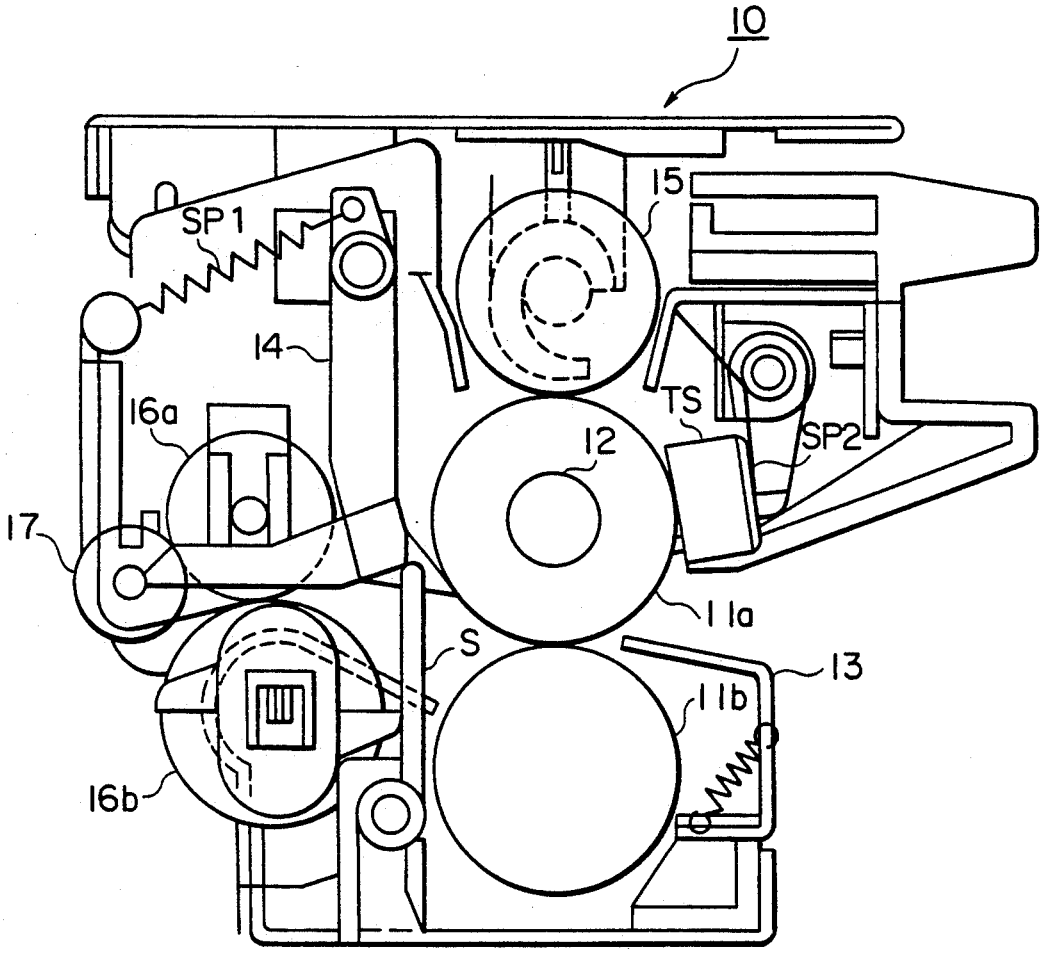
FIG. 1 is a sectional view showing a schematic arrangement of a fixing apparatus of the example of the invention.

FIG. 1 is a sectional view showing schematic composition of a fixing apparatus in the example of the invention.

Fixing apparatus 10 in the present example comprising fixing rollers 11*a* and 11*b* which apply heat and pressure on recording paper P for fixing toner images thereon, entering-point-regulating member 13, separation claw 14, cleaning roller 15, temperature sensor 15, paper-feeding sensor S and paper-ejecting rollers 16*a* and 16*b* which pull recording paper P having thereon fixed images toward the paper transport direction, is characterized in that curl-prevention roller 17 that guides the recording paper in the direction opposite to the direction of the curl generated on the recording paper in the course of image-fixing is provided therein.

Fixing roller 11*a* is a rigid roller made of aluminum having therein heating source 12 such as a halogen heater (hereinafter called rigid roller 11*a*) whose surface is covered with ethylene fluoride resin for Teflon-coating, and fixing roller 11*b* is an elastic roller made of rubber such as LTV or RTV (hereinafter called elastic roller 11*b*). For image-fixing, toner images contact rigid roller 11*a* and thereby heat is supplied from the image (toner image) side of the recording paper and pressure is given by elastic roller 11*b* from the reverse side of the recording paper. After image-fixing, the recording paper is ejected.

Entering-point-regulating member 13 regulates the position where the recording paper runs into fixing rollers 16*a* and 16*b*. The entering-point is deviated upward from the nip portion, for example, between rigid roller 11*a* and elastic roller 11*b*. Separation claw 14 is kept in contact with a peripheral surface of rigid roller 11*a* by spring SP1, thereby preventing the recording paper from winding round the rigid roller. The surface of cleaning roller 15 is covered with a web material which wipes off residual toners staying on the surface of rigid roller 11*a*. Temperature sensor TS such as, for example, thermistor TS keeps detecting the surface temperature of rigid roller 11*a* and the signals from temperature sensor TS keep the surface temperature of rigid roller 11*a* at about 110° C. Temperature sensor TS is urged with pressure against the surface of rigid roller 11*a* by spring SP2. Paper-feeding sensor S detects, when its detecting member is brought down by recording paper P transported in the direction of transport by paper-ejecting rollers 16*a* and 16*b* after image-fixing, that the recording paper has been transported to paper-ejecting rollers 16*a* and 16*b*, and when the detecting member keeps being brought down for 5 seconds or more, it results in a detection of jamming.

Figure 2:
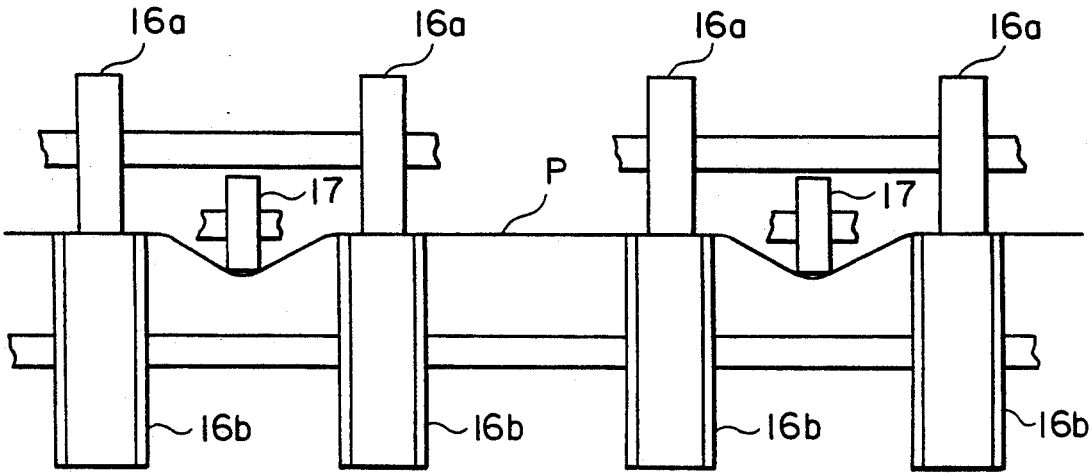
FIG. 2 is a front view showing the primary arrangement of the fixing apparatus of the example such as, for example, relation in terms of position between a nip portion of a paper-ejecting roller and a curl-correction roller.
Figure 3:
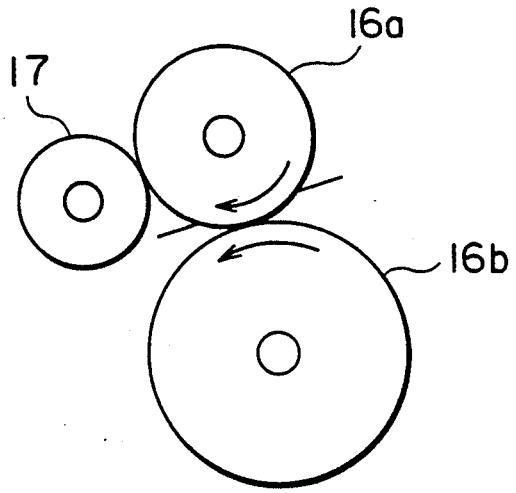
FIG. 3 is a sectional view showing the primary arrangement of what is shown in FIG. 2.

Arrangement of paper-ejecting rollers 16*a* and 16*b* as well as curl-prevention roller 17 which is a characteristic portion of the present example will be explained next. FIG. 2 is a front view showing the primary composition of a fixing apparatus in the present example such as, for example, the relation in terms of position between the nip portion of paper-ejecting rollers 16*a* and 16*b* and curl-prevention roller 17, and FIG. 3 is a sectional view showing the primary composition of what is shown in FIG. 2.

Paper-ejecting rollers 16*a* and 16*b* are resin-molded and on the surface of paper-ejecting roller 16*b*, in particular, rubber material is formed to increase the coefficient of rolling friction at a nip portion between paper-ejecting rollers 16*a* and 16*b*, and the peripheral speed of paper-ejecting rollers is set to be higher than that of fixing rollers 11*a* and 11*b* by about 5–10%. Incidentally, the nip portion between paper-ejecting rollers 16*a* and 16*b* is located to be higher than that between fixing rollers 11*a* and 11*b*. Respective two paper-ejecting rollers are mounted on the same driving shaft, while all paper-ejecting rollers 16*b* are mounted on the same driving shaft and are driven by a single driving source.

Curl-prevention roller 17 is resin-molded and it is located below the nip portion of paper-ejecting rollers 16*a* and 16*b* and further is located so that its peripheral surface is extremely close to that of paper-ejecting roller 16*a*. Curl-prevention roller 17 with its shaft supported by supporters and not connected to the driving source can be rotated freely by external force applied thereon through the recording paper.

Figure 4:
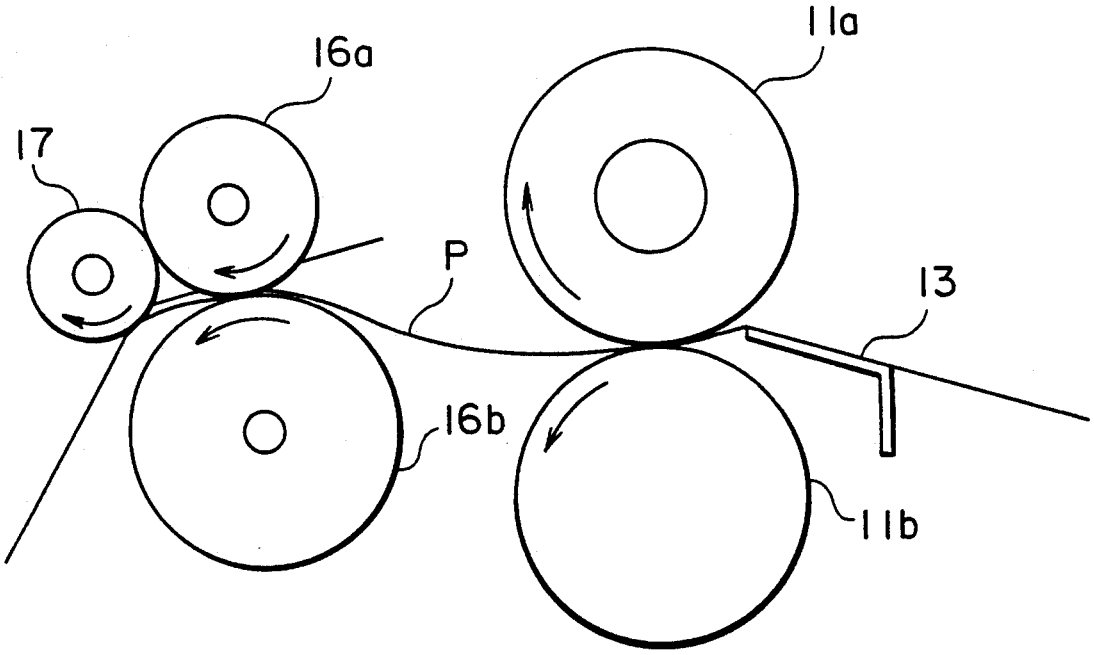
FIG. 4 is an illustrative diagram showing the transport path for a recording paper in the example.

FIG. 4 is a schematic diagram showing the transport path for the recording paper in the present example.

With an example of an electrophotographic apparatus, the process including an image-forming process, a transfer process, a fixing process and a paper-ejecting process will be explained next. Electrostatic latent images on an unillustrated photoreceptor drum are developed to be visible toner images which are transferred by means of an unillustrated transfer electrode onto recording paper P. Recording paper P having thereon transferred toner images is transported by a conveyance belt to the predetermined point on the peripheral surface of rigid roller 11*a* through entering-point-regulating member 13. In the fixing process, rigid roller 11*a* is heated by halogen heater 12 and temperature on the surface of the rigid roller is detected by thermistor TS and controlled to be constant. Recording paper P carrying thereon unfixed images is transported, through entering-point-regulating member 13, to the nip portion formed between a pair of rollers 11*a* and 11*b* where heat and pressure are applied to the recording paper and thereby the unfixed images are fixed firmly on recording paper P. In this case, fixing roller 11*a* is deformed less than elastic roller 11*b* having thereon an elastic layer such as a silicone rubber layer, causing the recording paper to be bent (curled) toward rigid roller 11*a* side following the curvature formed at the nip portion. Further, rigid roller 11*a* is higher in terms of temperature on its surface tan elastic roller 11*b* because of heating source 12 located in the rigid roller, thereby giving more heat to the recording paper than elastic roller does.

Therefore, moisture in the recording paper on the side of rigid roller 11*a* is reduced remarkably and in addition to that fibers in the recording paper on the side of rigid roller 11*a* change extremely. Besides, when the developer-parting property (mold-releasing property) on the surface of rigid roller 11*a* is poor, the curl tends to occur more easily because recording paper P and rigid roller 11*a* contact each other.

The recording paper after image-fixing is to be separated from rigid roller 11*a* and then ejected. When the recording paper is not separated easily, however, it is separated by separation claw 14 whose tip is pressed lightly by coil spring SP1 against the surface of fixing roller 11*a*, and then transported to the nip portion between paper-ejecting rollers 16*a* and 16*b*. In this case, paper-feeding sensor S detects, when its detecting member is brought down by recording paper P transported in the direction of transport by paper-ejecting rollers 16*a* and 16 *b* after image-fixing, that the recording paper has been transported to paper-ejecting rollers 16*a* and 16*b*.

A pair of paper-ejecting rollers 16*a* and 16*b* guide curled recording paper P to the nip portion formed between paper-ejecting rollers 16*a* and 16*b* and then sandwich it, through the method of contact to paper-ejecting roller 16*b* whose surface is formed with rubber material or of rotation of paper-ejecting roller 16*a*. Under such condition, recording paper has not been cooled down yet. Namely, recording paper P is ejected while being pulled in the direction of paper-ejection by paper-ejecting rollers 16*a* and 16*b* whose peripheral speed is higher by about 5–10% than that of fixing rollers 11*a* and 11*b* before the curl has been set. However, an apparatus in the present example is further provided with curl-prevention roller 17 for the purpose of correcting the generated curl as stated previously.

Due to the arrangement that the peripheral surface of curl-prevention roller 17 where it contacts recording paper P is located below the nip portion of a pair of paper-ejecting rollers 16*a* and 16*b*, the curl-prevention roller may guide recording paper P toward the direction opposite to the curl generated in the course of image-fixing on recording paper P, offering an effect of fanning the paper. This enables the recording paper to be free from the curl generated thereon after image-fixing, before it is ejected. In this case, curl-prevention roller 17 touches recording paper P and thereby is rotated by the external force in the direction of transport of recording paper P given therefrom, which causes less friction between curl-prevention roller 17 and the image side of the recording paper, resulting in an advantage of no soil on the image side of the recording paper.

When fixing apparatus 10 in the present example is applied to an electrophotographic appratus, it is possible to eliminate disadvantages caused by the curl generated in the course of image-fixing such as, for example, occurrence of jamming and deterioration of paper transportability in duplex copying in an electrophotographic apparatus.

An effective application of the curl-prevention roller of the invention is not limited only to a heat-roller fixing method. The curl-prevention roller can be applied effectively also to an electrophotographic apparatus employing the fixing method of an oven-chamber heating, a radio-frequency heating or a heat-plate heating.

As stated above, the invention provides a fixing apparatus comprising a fixing member that supplies heat and pressure to a recording paper having thereon unfixed images for image-fixing therefor and ejects it as well as a paper-ejecting member that ejects the recording paper after image-fixing thereon, and thereby pulls the recording paper in the paper-transport direction before the curl generated on the recording paper has been set, wherein there is provided a curl-prevention roller that guides the recording paper toward the direction opposite to the curl generated on the recording paper in the course of image-fixing whereby the curl staying after image-fixing is corrected for ejection of the recording paper, thus eliminating disadvantages caused by the curl.

What is claimed is:

1. A fixing apparatus for fixing a toner image formed on a recording paper, comprising:

a fixing device for fixing said toner image which applies heat and pressure to said recording paper and conveys said recording paper in a conveying direction;

an ejector, located downstream of said fixing device in said conveying direction, for ejecting said recording paper in an ejecting direction from a predetermined position thereof; and a corrector, comprising a follower roller, located downstream of said ejector, for correcting a paper curl in said recording paper, which corrector does not nip but bends said recording paper to form a bending curvature opposite to the curvature of said paper curl by pushing said recording paper form one side thereof whereby said recording paper is made to pass through one predetermined point.

2. The fixing apparatus of claim 1 wherein rotation of said follower roller is solely by impetus of said recording paper.

3. A fixing apparatus comprising;

means for fixing a toner image on a recording paper by applying heat and pressure to said recording paper; which conveys the recording sheet in a conveying direction;

an ejector, having a pair of ejecting rollers and located downstream of said fixing device in said conveying direction, for ejecting said recording paper, said ejector rollers nipping said recording paper along a nip line thereof and ejecting said recording paper in an ejecting direction; and a rotatable roller located downstream of said ejector in said ejecting direction for pushing said recording paper by contacting said recording paper from one said thereof along a contact line so that a bending curvature opposite to a sheet curl is formed in a portion of said recording paper between said nip line and said contact line, wherein the portion of said recording paper contacts the fixing apparatus solely along two lines of the nip line and the contact lie.

4. The fixing apparatus of claim 3 wherein said rotatable roller is rotatable solely by impetus of said recording paper.

5. A fixing apparatus for fixing a toner image formed on a recording paper, said apparatus comprising;

a fixing device for fixing a toner image by applying heat and pressure to said recording paper, said fixing device further conveying said recording paper in a conveying direction;

an ejector having a pair of ejector rollers located downstream of said fixing device in said conveying direction for conveying said recording paper, said ejector rollers nipping said recording paper along a nip line thereof, and ejecting said recording paper in an ejecting direction; and a plurality of rotatable wheels disposed coaxially and spaced apart, in a width-wise direction of said recording paper, at a position downstream of said ejector, in said ejecting direction, said wheels pushing said recording paper at a plurality of points on one surface thereof, whereby said recording paper forms a ending curvature with a corrugated deformation between said plurality of said rotatable wheels and said nip line, wherein said bending curvature is opposite to a sheet curl, and said recording paper in said bending curvature contacts said fixing apparatus only at said nip line and at said wheels.

* * * * *